US006152156A

United States Patent [19]

Tung

[11] Patent Number: 6,152,156

[45] Date of Patent: Nov. 28, 2000

[54] SUNSHADE WITH A TILTABLE CANOPY

[76] Inventor: Pai Tung, No. 2, Cheng Shing Rd., San Min, Kaohsiung, Taiwan

[21] Appl. No.: 09/224,967

[22] Filed: Jan. 4, 1999

[51] Int. Cl.[7] ..... A45B 11/00

[52] U.S. Cl. ..... 135/21; 135/20.1

[58] Field of Search ..... 135/15.1, 21, 29, 135/31–32, 38–39, 98, 20.1, 20.3

[56] References Cited

U.S. PATENT DOCUMENTS

| | | | |
|---|---|---|---|
| 4,449,542 | 5/1984 | McSwain | 135/98 |
| 5,002,081 | 3/1991 | Stromeyer | 135/21 |
| 5,116,258 | 5/1992 | Vennik | 135/20.3 |
| 5,261,435 | 11/1993 | Stanley | 135/90 |
| 5,499,644 | 3/1996 | Geniele | 135/20.1 |
| 5,611,364 | 3/1997 | Woods | 135/21 |
| 5,735,302 | 4/1998 | Saliva | 135/20.1 |
| 5,845,665 | 12/1998 | Koehn | 135/98 |
| 5,937,881 | 8/1999 | Villa | 135/20.1 |
| 5,937,882 | 8/1999 | Harbaugh | 135/20.3 |

*Primary Examiner*—Beth A. Stephan
*Attorney, Agent, or Firm*—Alan Kamrath

[57] ABSTRACT

A sunshade includes a supporting rod, a canopy support frame, and a canopy. An adjusting sleeve is slidably mounted around the supporting rod. A holding sleeve is pivotally connected to an upper end of the supporting rod. An arcuate tube is slidably extended through the holding sleeve. An elbow is mounted to a first end of the arcuate tube and a reel is mounted to a second end of the arcuate tube. A connecting rod is connected between the second end of the arcuate tube and the adjusting sleeve. An anchor is provided to be releasably engaged in an anchor room in the elbow to reliably retain the canopy support frame in a desired tilting angle relative to the supporting rod.

5 Claims, 9 Drawing Sheets

SUNSHADE WITH A TILTABLE CANOPY

BACKGROUND OF THE INVENTION

1. Field of the Invention

The present invention relates to a sunshade with a tiltable canopy.

2. Description of the Related Art

A sunshade may provide a comfortable space for outdoor activities. A so-called free-arm sunshade manufactured by Glatz Ltd. includes a main frame, a canopy support frame, and a canopy. Although the canopy support frame of the free-arm sunshade is tiltable (rotatable) in all directions to obtain optimum shade, it is, however, found that the adjustment is troublesome. More specifically, the user has to lower the canopy to a reachable level (otherwise a chair or the like is required to reach the canopy), rotate the canopy, and raise the canopy again. The user must operate the mechanism for adjusting the height of the canopy twice. In addition, the device allowing rotation of the canopy in all directions is complicated and might be actuated by strong wind.

The present invention is intended to provide an improved sunshade that allows easy operation in adjusting the tilting angle of the canopy.

SUMMARY OF THE INVENTION

It is a primary object of the present invention to provide an improved sunshade in which the canopy is tiltable, and adjustment of the tilting angle of the canopy can be easily achieved.

It is another object of the present invention to provide an improved sunshade in which the canopy can be reliably retained in a desired tilting angle.

It is a further object of the present invention to provide an improved sunshade that is foldable. In addition, the canopy support frame together with the canopy can be disengaged from the elbow when not in use.

A sunshade in accordance with the present invention comprises:

a supporting rod having a lower end and an upper end, an adjusting sleeve slidably mounted around the supporting rod, a holding sleeve pivotally connected to the upper end of the supporting rod, an arcuate tube slidably extended through the holding sleeve and including a first end and a second end, an elbow connected to the first end of the arcuate tube and including an anchor room, an anchor releasably engaged in the anchor room, a canopy support frame for supporting a canopy and including a suspension member connected to the elbow, an upper support base having a plurality of ribs attached thereto for supporting a canopy, and a lower support base having a plurality of stretchers attached thereto for supporting the ribs, the lower support base being connected to the anchor, a reel mounted to the second end of the arcuate tube and including a handle, a cable having a first end connected to the handle and a second end connected to the anchor, the cable being movable in a retracting direction and a releasing direction, a connecting rod connected between the second end of the arcuate tube and the adjusting sleeve, wherein when the handle is operated to release the cable in the releasing direction, the anchor is disengaged from the anchor room of the elbow while the canopy is folded, and when the handle is operated to retract the cable in the retracting direction, the anchor is moved into he anchor room and thus engages the suspension member with the elbow when the canopy is in a fully opened status, and wherein the adjusting sleeve is slidable along the supporting rod while the arcuate tube is slidable along the holding sleeve to adjust a tilting angle of the canopy relative to the supporting rod.

The arcuate tube includes a stop to restrain sliding movement of the arcuate tube relative to the holding sleeve. Preferably, the stop bears against the holding sleeve when the canopy is in an upright position.

The adjusting sleeve includes an extension extended outwardly and upwardly and having a groove defined therein. The connecting rod includes a first end pivotally connected to the extension and a second end pivotally connected to the second end of the arcuate tube. A positioning sleeve is slidably mounted to the connecting rod and movable between a first position covering the groove of the extension to retain the connecting rod in place and a second position disengaged from the extension to allow pivotal movement of the connecting rod relative to the extension.

The suspension member includes a transverse hole defined in a periphery thereof, and the upper support base includes a tube having a button mounted to an upper end thereof and biased outwardly by an elastic member. The button is releasably extended through the transverse hole of the suspension member to releasably connect the suspension member with the upper support base.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
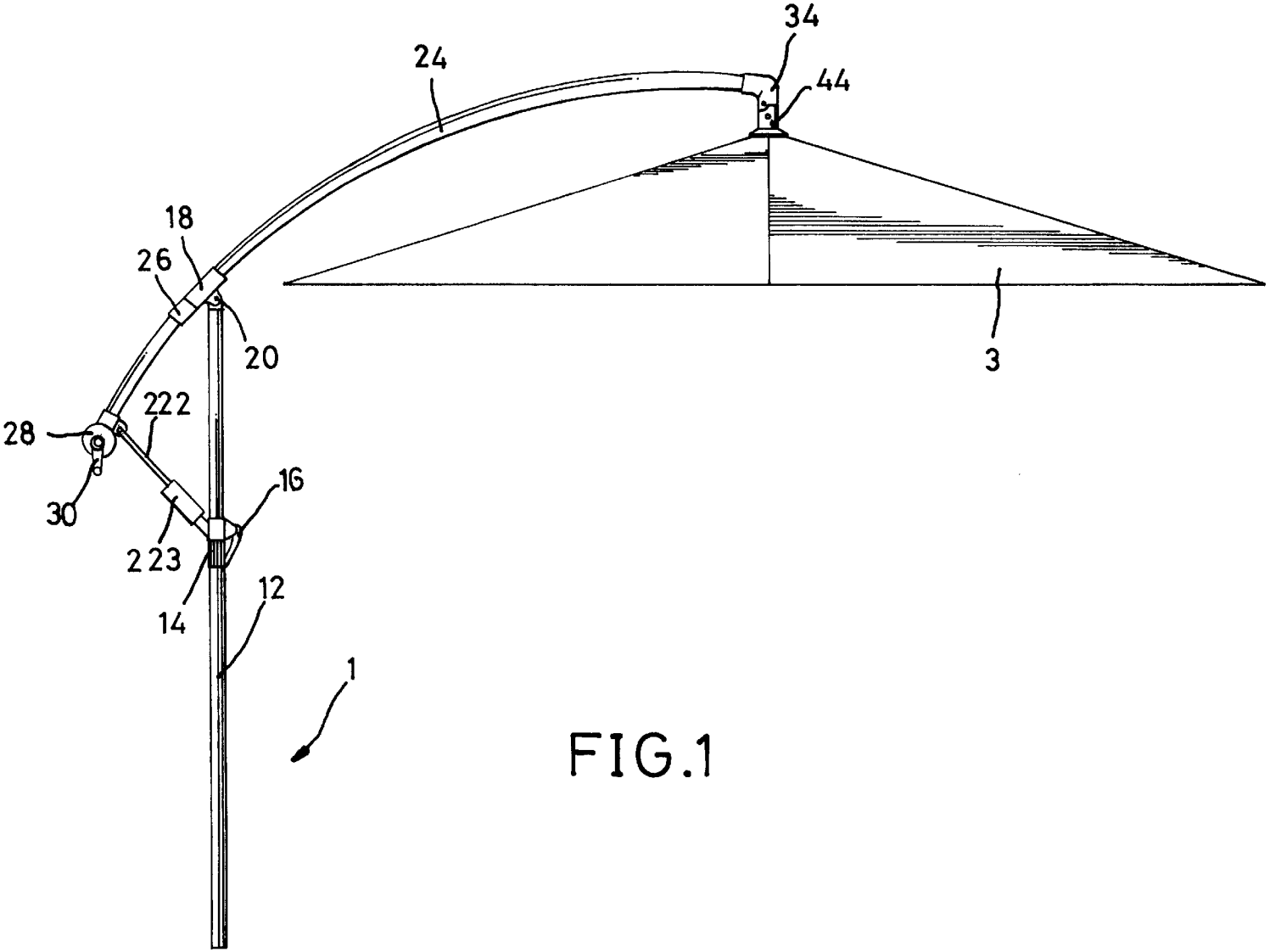
FIG. 1 is a perspective view of a sunshade in accordance with the present invention.

Referring to the drawings and initially to FIG. 1, a sunshade in accordance with the present invention generally includes a main frame 1, a canopy support frame 2 (FIG. 3), and a canopy 3. The main frame 1 includes a supporting rod 12, an adjusting sleeve 14 slidably mounted around the supporting rod 12, and a lever 16 mounted to the adjusting sleeve 14. When the lever 16 is in a locked position, the adjusting sleeve 14 is frictionally retained in place, and when the lever 16 is in a released position, sliding movement of the adjusting sleeve 14 relative to the supporting rod 12 is allowed. A holding sleeve 18 is pivotally connected to an upper end of the supporting rod 12 at 20. An arcuate tube 24 is slidably extended through the holding sleeve 18 and includes an elbow 34 mounted to a first end thereof and a reel 28 mounted to a second end thereof The reel 28 includes a handle 30 for manual operation for folding or unfolding the canopy 3, which will be described later.

Figure 2:
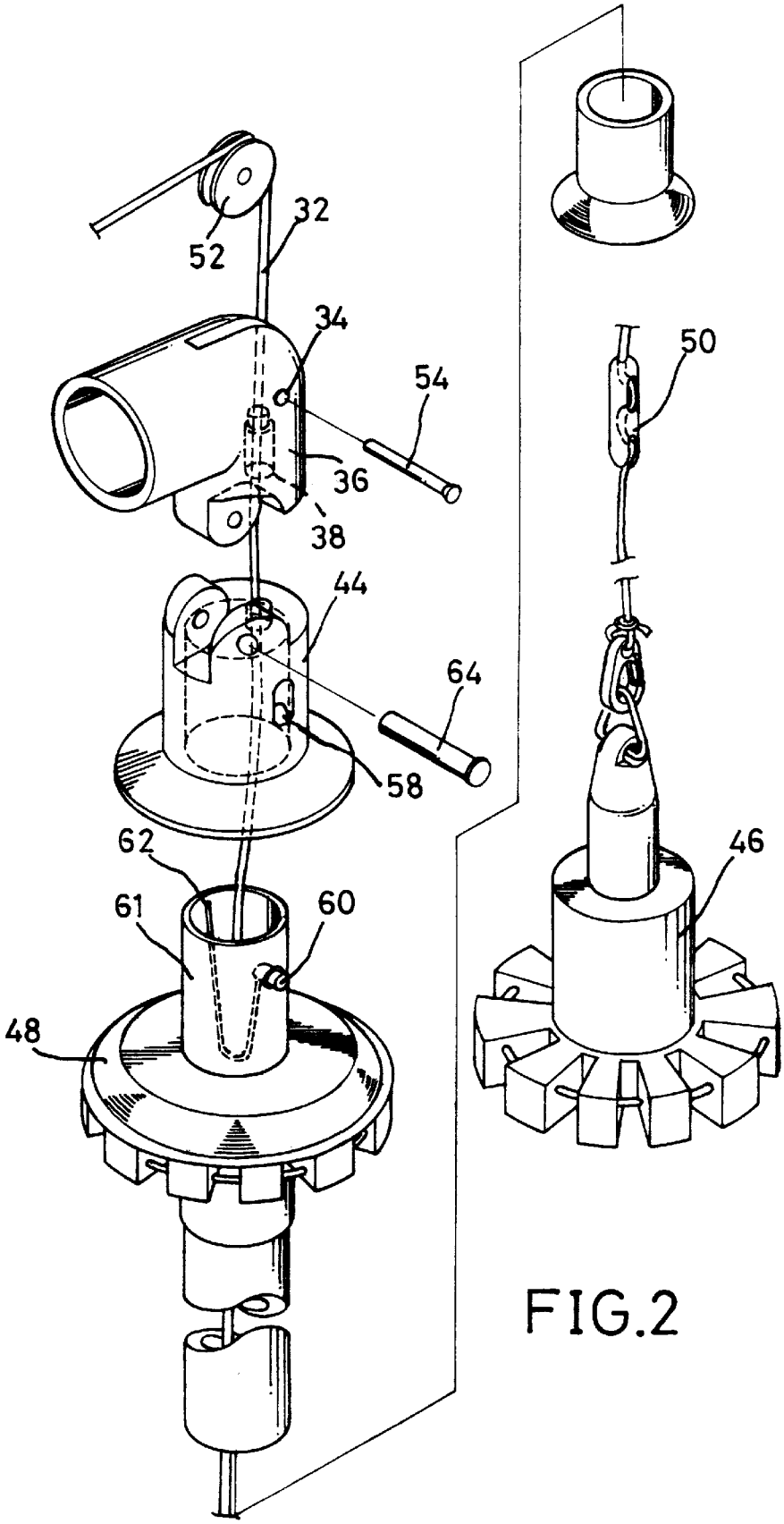
FIG. 2 is an exploded perspective view of a canopy support frame of the sunshade.
Figure 3:
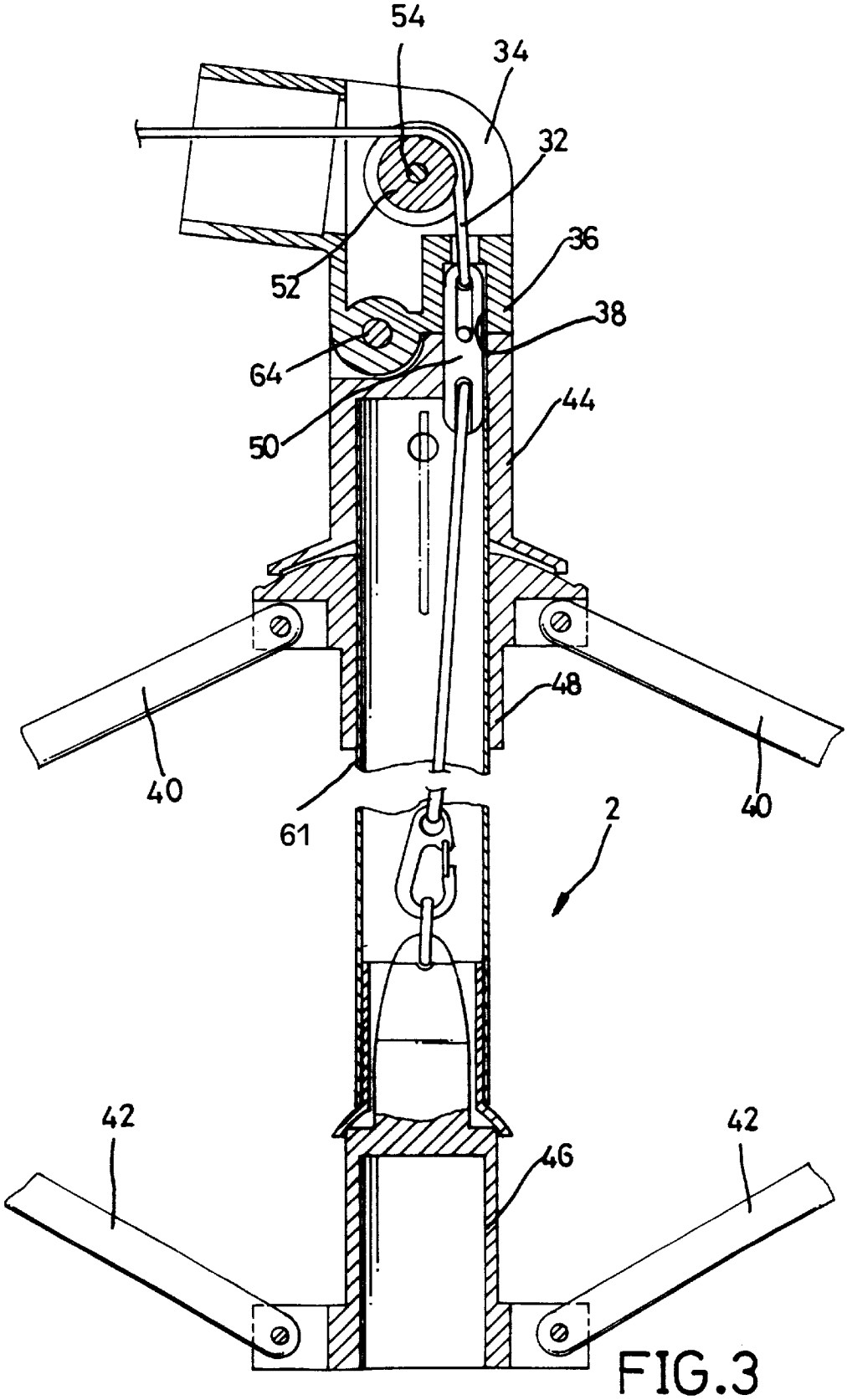
FIG. 3 is a partial sectional view of the sunshade, wherein the canopy support frame is in a fully extended status.

Referring to FIGS. 2 and 3, the canopy support frame 2 includes a suspension member 44, an upper support base 48 having a number of ribs 40 attached thereto for supporting the canopy 3, and a lower support base 46 having a number of stretchers 42 attached thereto for supporting the ribs 40. The elbow 34 includes a horizontal section (not labeled) and a vertical section 36 having an anchor room 38 defined therein. A cable 32 includes a first end attached to and operable by the handle 30 of the reel 28 so as to be movable in a retracting direction and a releasing direction. A second end of the cable 32 is secured to an anchor 50 after being wound through a pulley 52, which, in turn, is freely rotatably mounted in the elbow 34 by a pin 54. The suspension member 44 is connected to the vertical section 36 of the elbow 34 by a pin 64. The upper support base 48 is releasably engaged with the suspension member 44. In this embodiment, the upper support base 48 includes a tube 61 having a button 60 mounted to an upper end thereof and biased outwardly by an elastic member 62. The suspension member 44 includes a transverse hole 58 defined in a periphery thereof. In assembly, the tube 61 is inserted into the suspension member 44, and the button 60 is depressed by an inner wall of the suspension member 44 until the button 60 reaches the transverse hole 58 and extended outwardly under the action of the elastic member 62, thereby providing a secure engagement between the suspension member 44 and the tube 61. Detachment of the suspension member 44 and the tube 61 can be easily achieved by pushing the button 60 and pulling the tube 61 downwardly. The lower support base 46 includes an upper end securely connected to the anchor 50 by any suitable means.

Figure 4:
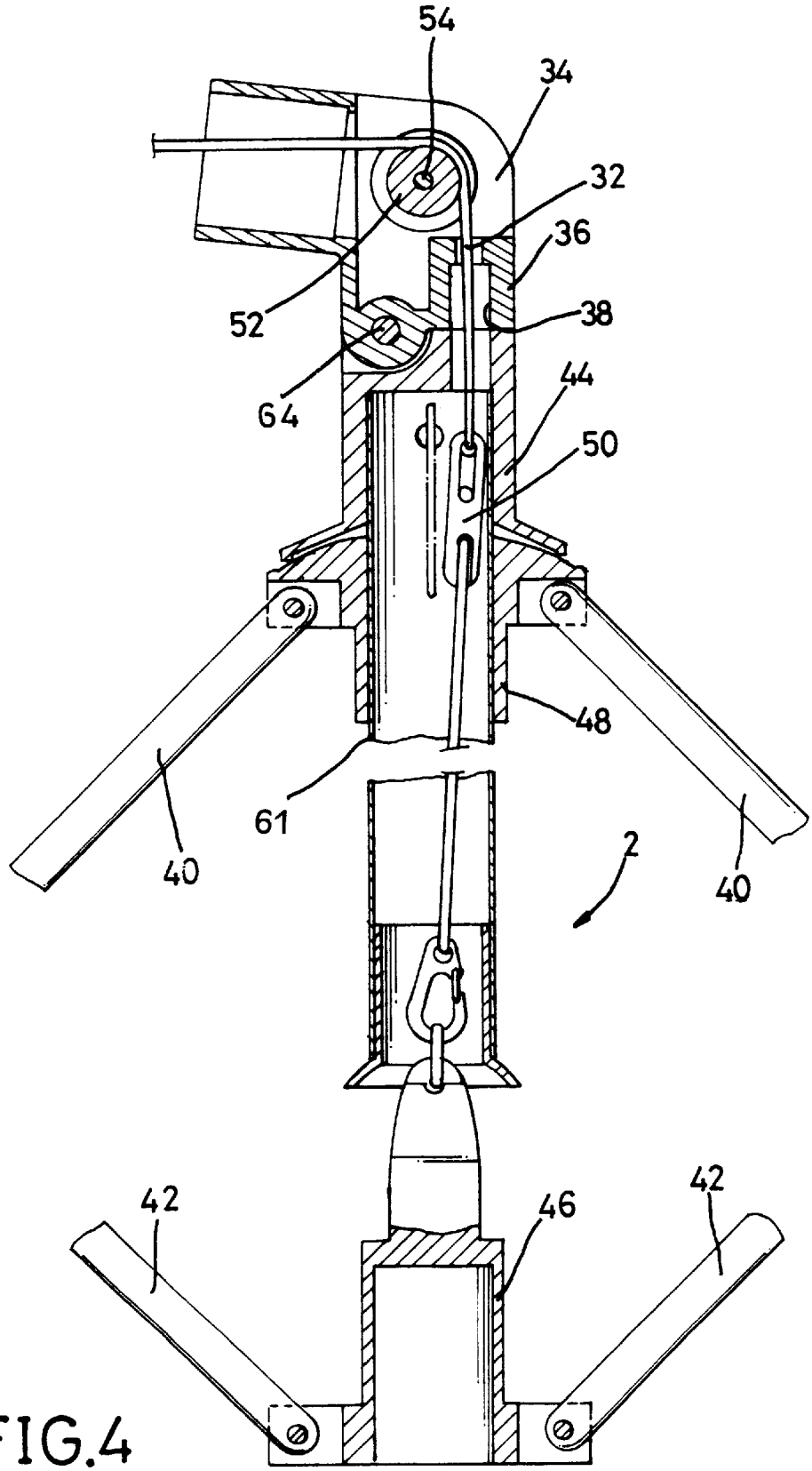
FIG. 4 is a view similar to FIG. 3, illustrating a folding operation of the canopy support frame.
Figure 9:
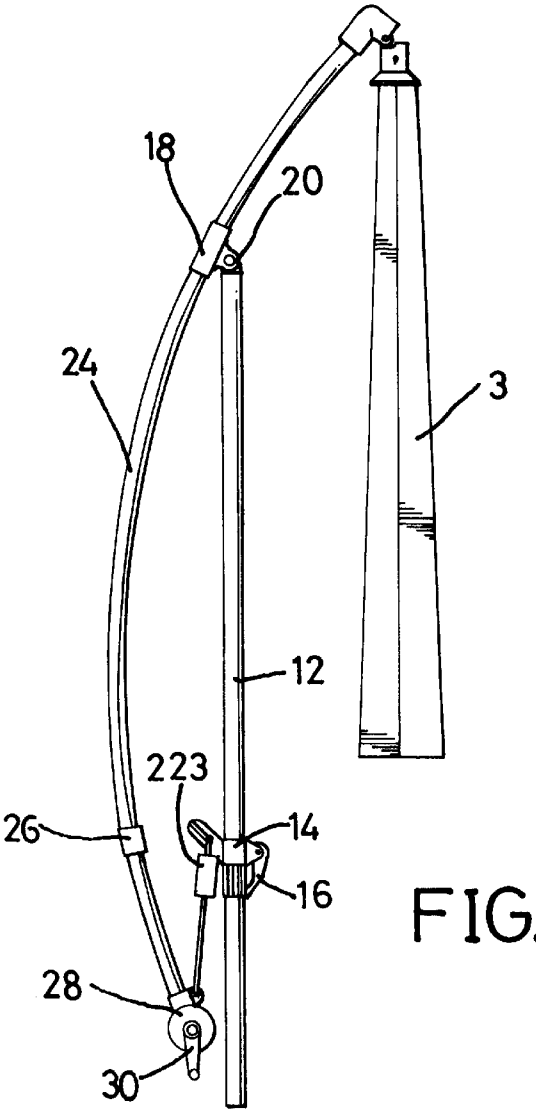
FIG. 9 is a side view of the sunshade in a fully folded status.

The canopy 3 of the sunshade in FIG. 1 is in a fully opened status. When not in use, the user may operate the handle 30 to move the cable 32 in the releasing direction to thereby lower the anchor 50 such that the anchor 50 disengages from the anchor room 38 of the elbow 34 (FIG. 4), and the canopy 3 collapses (FIG. 9). The user may operate the handle 30 to move the cable 32 in the retracting direction to raise the anchor 50 until the anchor 50 enters and is thus anchored in the anchor room 38, best shown in FIG. 3. The anchor 50 securely engages the elbow 34 with the suspension member 44, the purpose of which will be described later.

Figure 5:
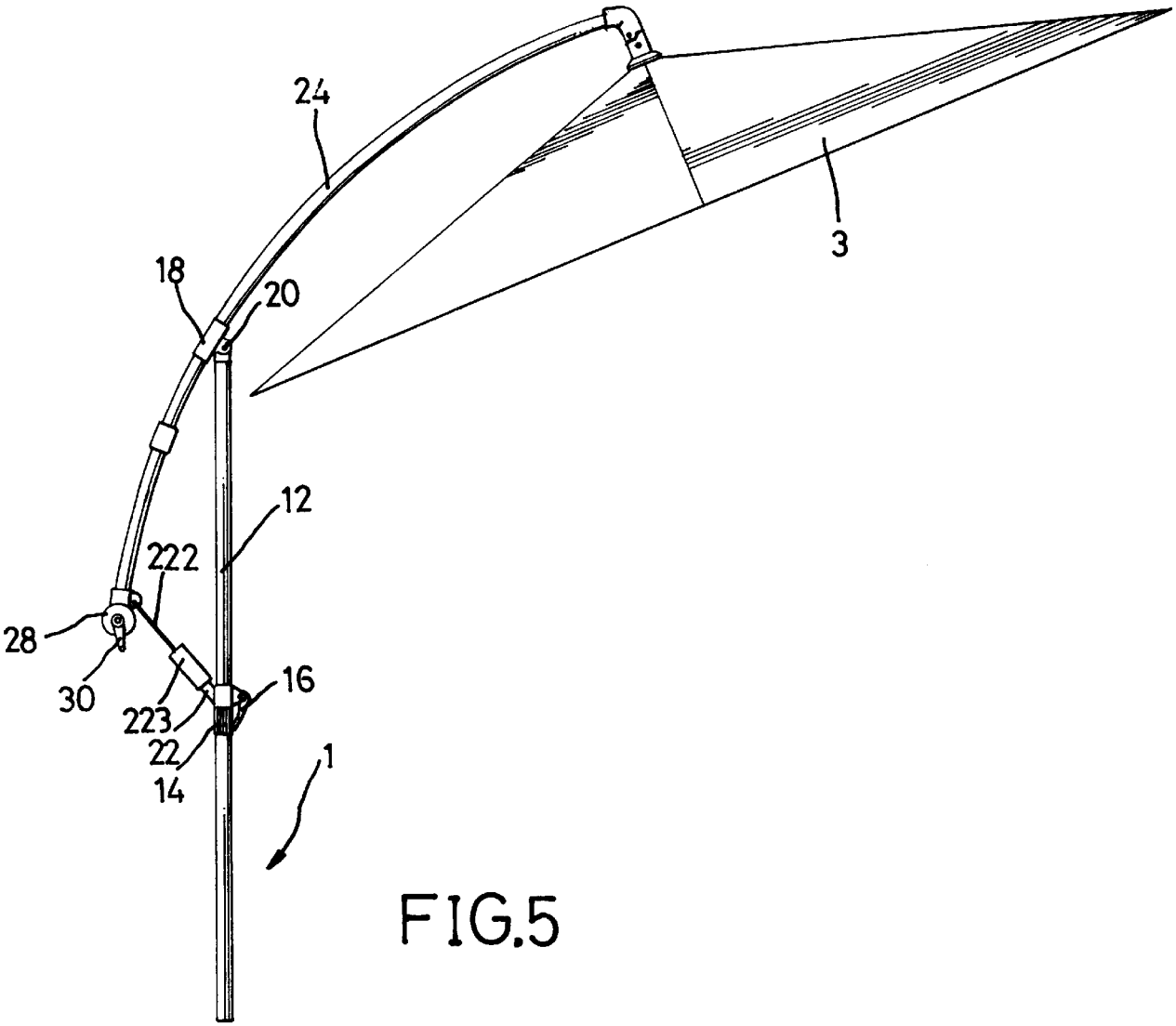
FIG. 5 is a side view illustrating tilting of the canopy.

The canopy of the sunshade in FIG. 1 is in an upright, non-tilting position. The arcuate tube 24 includes a stop 26 for restraining the position of the arcuate tube 24. As shown in FIG. 1, the stop 26 bears against the holding sleeve 18 when the canopy 3 is in the upright position. Referring to FIG. 5, when adjustment of the tilting angle of the canopy 3 is required, the lever 16 is released to allow the adjusting sleeve 14 to move downwardly along the supporting rod 12. The arcuate tube 24 is slid along the holding sleeve 18 until a desired tilting angle of the canopy 3 is reached for optimum shade. The lever 16 is then switched to its locked position. The pivotal connection between the holding sleeve 18 and the supporting rod 12 assists in smooth sliding movement of the arcuate tube 24 relative to the holding sleeve 18. Of more importance, the anchor 50 securely engages the suspension member 44 with the elbow 34 such that the canopy 3 can be reliably retained in a desired tilting angle relative to the vertical axis of the supporting rod 12.

Figure 6:
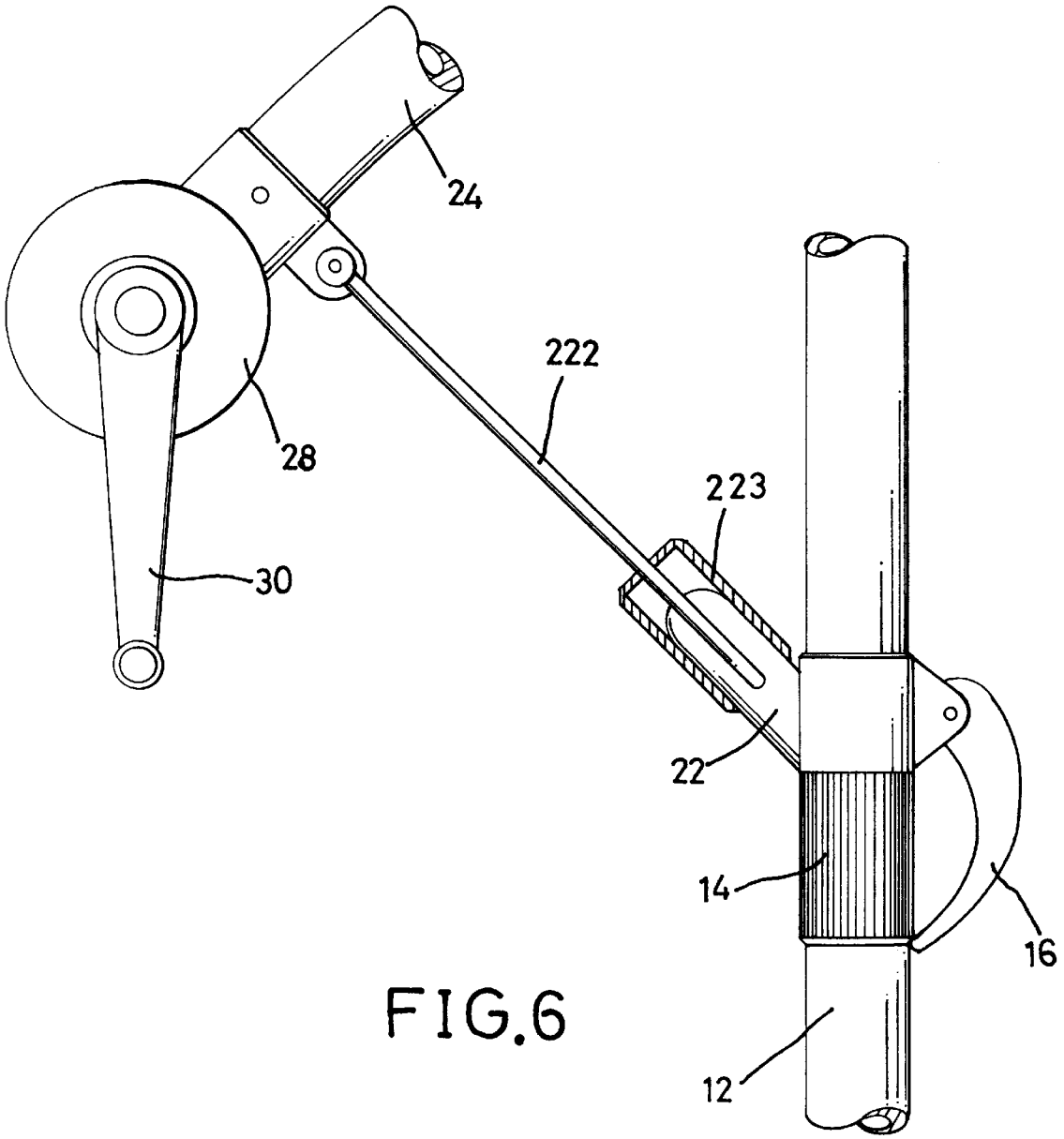
FIG. 6 is a partially sectioned side view of a portion of a main frame of the sunshade.
Figure 7:
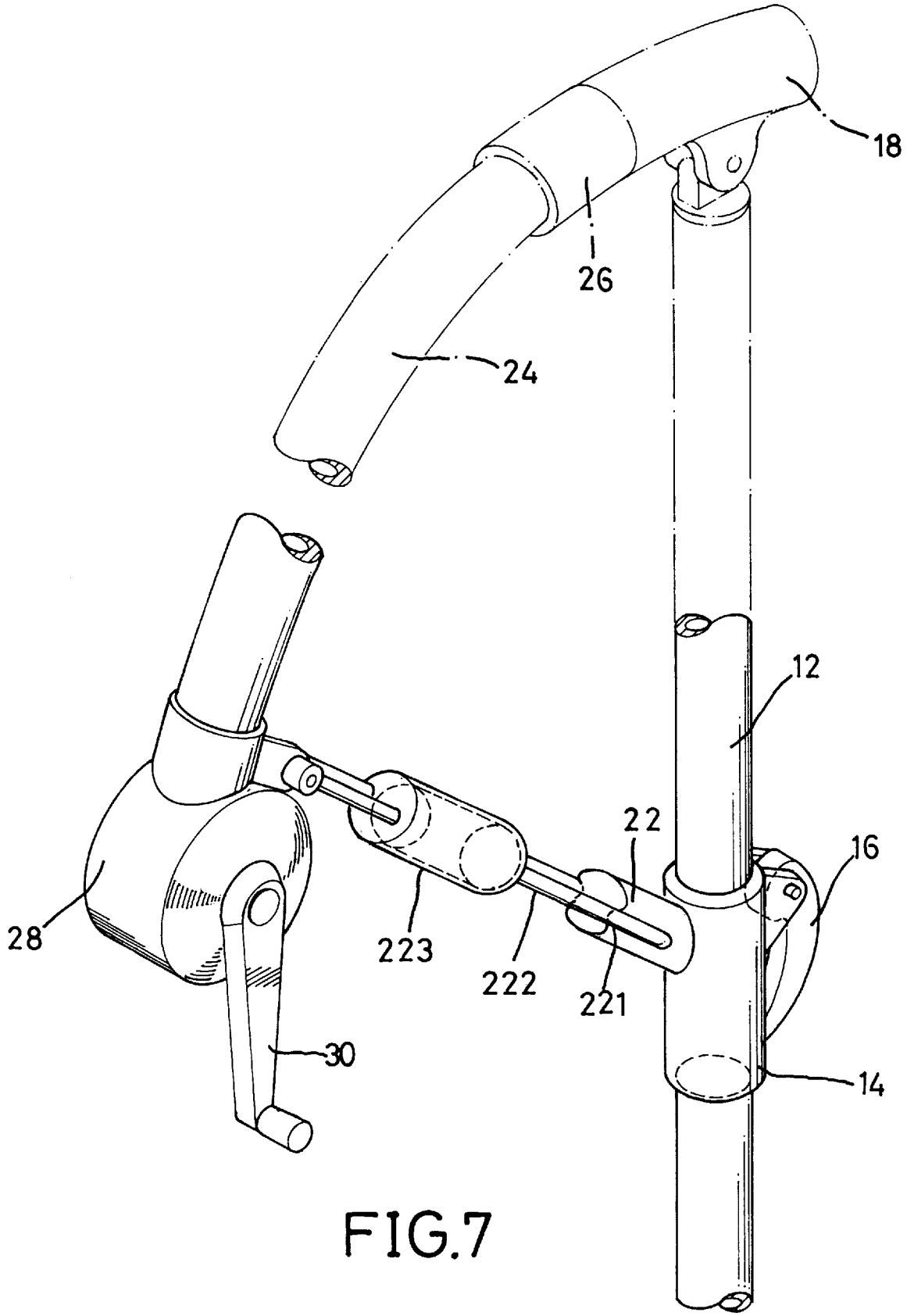
FIG. 7 is a partial perspective view illustrating a folding operation of the main frame.
Figure 8:
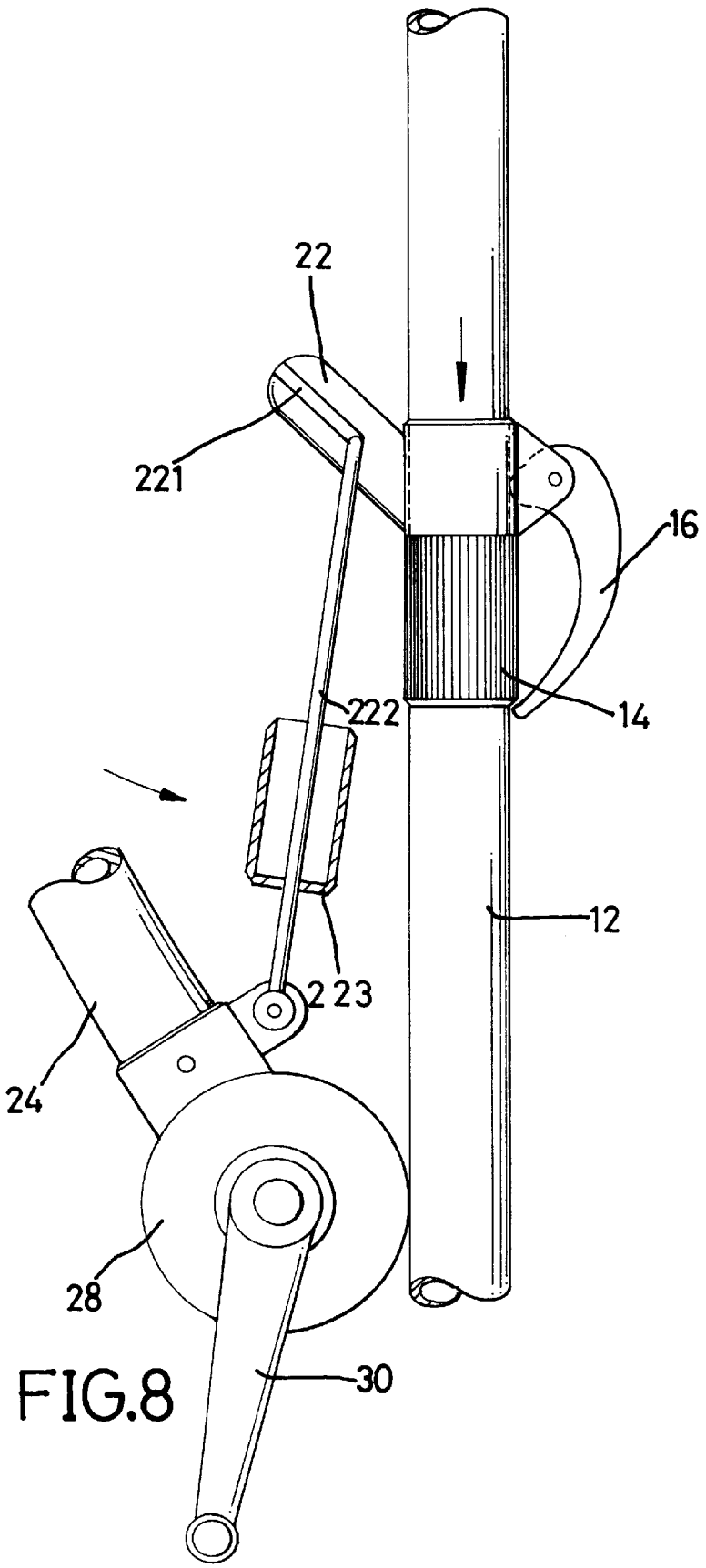
FIG. 8 is a partially sectioned side view of the portion of the main frame in a folded status.

Turning to FIGS. 6 and 7, the adjusting sleeve 14 includes an extension 22 extended outwardly and upwardly and having at least one groove 221 (two grooves 221 in this embodiment). At least one connecting rod 222 (two rods in this embodiment) has a first end pivotally connected to the extension 22 and a second end pivotally connected to the second end of the arcuate tube 24. A positioning sleeve 223 is slidably mounted to the connecting rods 222. When the positioning sleeve 223 is moved to a position that encloses the grooves 221 of the extension 22 of the adjusting sleeve 14, the arcuate tube 24 is supported, and the sunshade is in an unfolded status, best shown in FIG. 6. When not in use, the positioning sleeve 223 is moved away from the extension 22 of the adjusting sleve 14, as shown in FIG. 7, such that the connecting rods 222 can be pivoted downwardly to leave the grooves 221 to a position shown in FIG. 8. The grooves 221 may have a dimension for holding a portion of the connecting rods 222 yet allow disengagement of the connecting rods 222 from the grooves 221 by means of forcibly pivoting the connecting rods 222 about the adjusting sleeve 14. It is appreciated that folding of the connecting rods 222 can be proceeded after the adjusting sleeve 14 is moved to its lowest position, best shown in FIG. 9. Thus, the sunshade can be folded and occupy a smaller space when not in use, which is convenient for storage and transportation.

According to the above description, it is appreciated that the tilting angle of the canopy of the sunshade of the present invention can be easily adjusted, and the canopy is reliably retained in the desired tilting position after adjustment. In addition, the whole sunshade can be further collapsed after folding the canopy. Furthermore, the canopy support frame 2 together with the canopy 3 can be disengaged from the elbow 34 when not in use.

Although the invention has been explained in relation to its preferred embodiment, it is to be understood that many other possible modifications and variations can be made without departing from the spirit and scope of the invention as hereinafter claimed.

What is claimed is:

1. A sunshade comprising:

a supporting rod having a lower end and an upper end, an adjusting sleeve slidably mounted around the supporting rod, a holding sleeve pivotally connected to the upper end of the supporting rod, an arcuate tube slidably extended through the holding sleeve and including a first end and a second end, an elbow connected to the first end of the arcuate tube and including an anchor room, an anchor releasably engaged in the anchor room, a canopy support frame for supporting a canopy and including a suspension member connected to the elbow, an upper support base having a plurality of ribs attached thereto for supporting a canopy, and a lower support base having a plurality of stretchers attached thereto for supporting the ribs, the lower support base being connected to the anchor, a reel mounted to the second end of the arcuate tube and including a handle, a cable having a first end connected to the handle and a second end connected to the anchor, the cable being movable in a retracting direction and a releasing direction, a connecting rod connected between the second end of the arcuate tube and the adjusting sleeve, wherein when the handle is operated to release the cable in the releasing direction, the anchor is disengaged from the anchor room of the elbow while the canopy is folded, and when the handle is operated to retract the cable in the retracting direction, the anchor is moved into the anchor room and thus engages the suspension member with the elbow when the canopy is in a fully opened status, and wherein the adjusting sleeve is slidable along the supporting rod while the arcuate tube is slidable along the holding sleeve to adjust a tilting angle of the canopy relative to the supporting rod.

2. The sunshade as claimed in claim 1, wherein the arcuate tube includes a stop to restrain sliding movement of the arcuate tube relative to the holding sleeve.

3. The sunshade as claimed in claim 2, wherein the stop bears against the holding sleeve when the canopy is in an upright position.

4. The sunshade as claimed in claim 1, wherein the adjusting sleeve includes an extension extended outwardly and upwardly and having a groove defined therein, the connecting rod includes a first end pivotally connected to the extension and a second end pivotally connected to the second end of the arcuate tube, a portion of the connecting rod being releasably received in the groove, and a positioning sleeve being slidably mounted to the connecting rod and movable between a first position covering the groove of the extension to retain the connecting rod in place and a second position disengaged from the extension to allow pivotal movement of the connecting rod relative to the extension.

5. The sunshade as claimed in claim 1, wherein the suspension member includes a transverse hole defined in a periphery thereof, and the upper support base includes a tube having a button mounted to an upper end thereof and biased outwardly by an elastic member, the button being releasably extended through the transverse hole of the suspension member to releasably connect the suspension member with the upper support base.

* * * * *